United States Patent [19]

Curtis

[11] Patent Number: 5,058,771

[45] Date of Patent: Oct. 22, 1991

[54] TUBE ROLLUP

[76] Inventor: William Curtis, 11020 N. 60th St., Stillwater, Minn. 55082

[21] Appl. No.: 450,427

[22] Filed: Dec. 14, 1989

[51] Int. Cl.[5] ..... B65D 35/32

[52] U.S. Cl. ..... 222/99

[58] Field of Search ..... 222/99, 100, 103

[56] References Cited

U.S. PATENT DOCUMENTS

| | | | |
|---|---|---|---|
| 1,692,213 | 11/1928 | Kielberg | 222/99 |
| 2,054,990 | 9/1936 | Newton et al. | 222/99 |
| 4,576,314 | 3/1986 | Elias et al. | 222/99 X |

FOREIGN PATENT DOCUMENTS

| | | | |
|---|---|---|---|
| 47447 | 3/1982 | European Pat. Off. | 222/99 |
| 334185 | 11/1958 | Switzerland | 222/99 |
| 1324161 | 7/1973 | United Kingdom | 222/99 |

*Primary Examiner*—Michael S. Huppert
*Assistant Examiner*—Gregory Huson
*Attorney, Agent, or Firm*—D. L. Tschida

[57] ABSTRACT

A windup holder mountable to a collapsible container for progressively ejecting stored contents from a spout and storing the spent container. A key member having a slotted body and a winged end mount in rotatively supported relation to a slotted, C-shaped support bracket. In an alternative embodiment, the key is rotatable in a single direction via annular geared portions of the body which mate with projections from the winged end of the key.

9 Claims, 11 Drawing Sheets

TUBE ROLLUP

BACKGROUND OF THE INVENTION

The present invention relates to a spent tube holder and, in particular, to holder that includes a wind up key that cooperates with a support bracket.

Collapsible tube storage containers for toothpaste and similar semi-solid materials for many years have been fabricated as soft metallic constructions. That is, a tubular storage section is fabricated and filled with particular contents. As the contents are used, the tube is progressively flattened and the spent tube is rolled upon itself.

The makeup of the tubing material typically is such that the spent tube does not unwind, once wound. A continual supply of the contained toothpaste or the like is thereby always available. By appropriately holding the wound end, movement of the stored materials is restricted to facilitate movement to this outlet port. Otherwise, the remaining materials, upon squeezing the tube, can migrate away from the outlet port, with consequent delays and aggravation in obtaining the stored material.

Although metallic tube structures permit a desirable feature of self-storage, they present the disadvantage of requiring separately printed labels and means for affixing the labels to the tubes. Attendant material and labor costs thus add to the overall container cost. Moreover with increasing public concerns for possible lead poisoning, industry has migrated to the use of various moldable, heat sealable polymers receptive to screen printing and other direct printing technologies.

Disadvantageously the latter tube materials lack shape retention properties do not facilitate self-storage. The aggravation of continually having to wind the spent tube upon itself, with each use, to eject the stored material has prompted Applicant to develop a separable mechanism for facilitating the winding and storage of spent polymer containers.

Applicant has accordingly developed a two-part keyed wind up mechanism. The invention not only stores the spent tube, but also pre-flattens the tube to secure complete removal of the stored contents. Although Applicant is aware of various singular slotted wind up key constructions which are formed from stamped metals or shaped wire stock, they do not provide for the present combinational construction and attendant advantages.

SUMMARY OF INVENTION

It is accordingly a primary object of the present invention to provide a mechanism for winding polymeric storage tubes.

It is a further object of the invention to provide a mechanism which prevents and/or minimizes the unwinding of the spent tube.

It is a further object of the invention to provide a mechanism for flattening the tube and directing the tube contents prior to winding the spent tube.

It is a still further object of the invention to provide a wind up assembly adaptable to low-cost molding technologies and having a minimal number of parts which readily mount to one another and the storage tube.

It is a still further object to provide an assembly which prevents untimely unrolling of the spent tube.

Various of the foregoing objects and advantages of the present invention are particularly provided for in a presently preferred and variously considered alternative embodiments described below. In its principal construction, the present holder comprises a key having a cylindrical body including a lengthwise through slot which receives one end of the tube and which extends substantially the length of the body. A hand hold, winged end facilitates winding. Bearing support portions are provided at a retainer or support bracket within which the key member slip mounts.

The support bracket includes a slotted body portion and from opposite ends of which extend transverse, bored arms whereat the key is rotatively supported and one of which includes a hand hold portion. In use, a partially-spent, pre-flattened tube is threaded through the slot of the retainer bracket onto the key, with the key thereafter storing the spent tube and the guide slot restricting migration of the stored contents, as the key is rotated.

In an alternative embodiment, cooperating ratchet means are provided for enabling a one way rotation of the key member relative to the support bracket.

Still other objects, advantages and distinctions of the invention will become more apparent upon reference to the following description with respect to the appended drawings. Although descriptive of various presently considered and preferred embodiments, the following description should not be interpreted in strict limitation of the invention. Rather it is illustrative only of the presently considered forms and invention subsequently claimed.

DESCRIPTION OF THE PREFERRED EMBODIMENT

Figure 1:
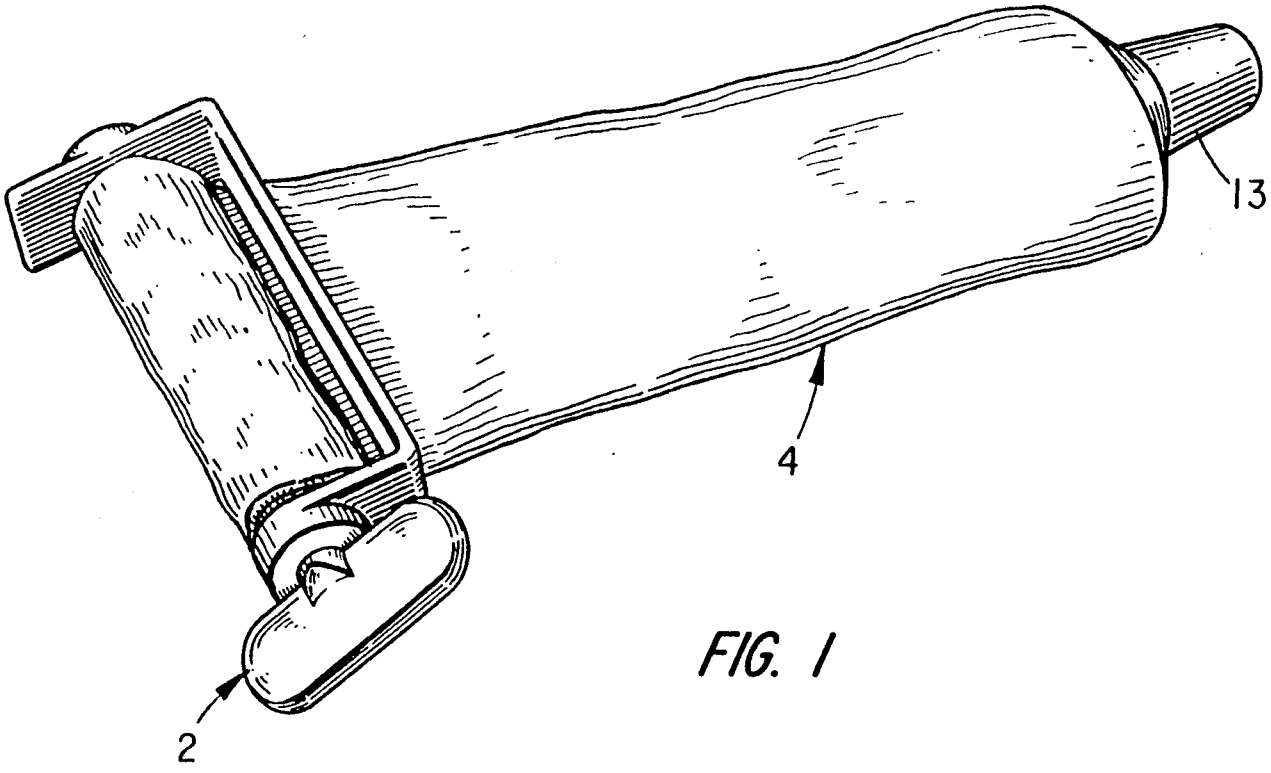
FIG. 1 shows an isometric drawing of a partially spent tube container wound on the holder of the present invention.
Figure 2:
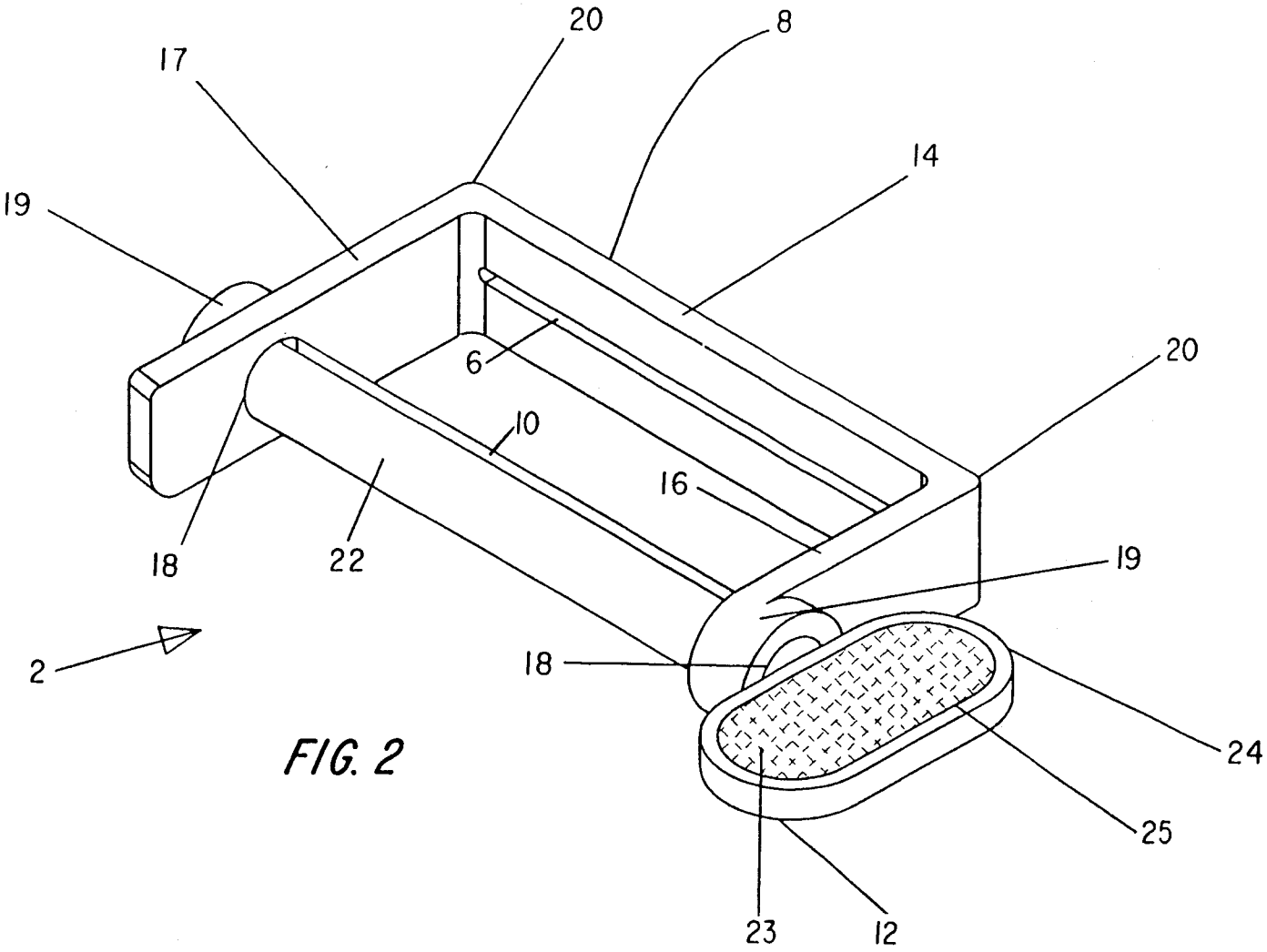
FIG. 2 shows an isometric drawing of a holder and closed ended key.

Referring to FIGS. 1 and 2, an isometric view is shown of the present tube rollup or holder assembly 2 as it appears in normal mounted relation to a partially spent tube container 4 and independent of the container 4. In normal use and once the contents of the container 4 are partially depleted, a heat sealed end of the container 4 is partially flattened and threaded though a slot 6 formed in the support bracket 8 of the holder 2. The tube end is next threaded through a slot 10 of the wind-up key portion 12. The key 12 is rotatable, either clockwise or counterclockwise, although is normally rotated in a single direction with further use, which causes the remaining tube contents to be squeezed toward the outlet port 13 via the cooperation of the holder slot 6 as the spent tube 4 is wound about the key 12.

Once the tube 4 is emptied of its contents, the key 12 is unwound, the tube 4 is disconnected from the key 12 and the tube 4 is discarded. The holder and key assembly 2 is then ready to receive a new tube.

Referring to FIGS. 2 through 7, respective isometric and detailed plan views are shown of the construction of the present holder assembly 2, the key 12 and the support bracket 8. FIGS. 2 and 5 through 7 particularly disclose the details of the support bracket 8 which generally comprises a central flattened bridge body portion 14 that includes the coextensive slot 6. The slot 6 is formed over size to accommodate the width and thickness of a typical, partially flattened tube. The forward edges of the slot 6 are chamfered or rounded to prevent puncturing the tube 4 as pressure is placed on the tube, as the key 12 is wound. The wall surfaces of the slot 6 may also taper inward from the forward edge of the bracket 14 to the aft edge to facilitate a squeezing action of the tube contents. Generally, though, the slot is sized and formed to effect a squeezing action without puncturing the tube 4 and whereby the remaining tube contents are forced toward the outlet port 13, as the spent tube is wound about the key 12.

Extending in transverse parallel relation from the ends of the central body portion 14 are a pair of offset arms 16 and 17. The arm 17 is slightly longer than the arm 16 to provide a handle or hand hold portion relative to the palm of the hand which supports the bracket. Otherwise, each of the arms 16 and 17 are cross bored to provide end bores 18 which receive and support an end portion of the key 12. Each bore 18 is sized to create a snug fit with the key 12, yet permit unrestricted rotation. The thickness of each arm 16 and 17 is slightly increased in the area 19 at each bore 18 to add rigidity thereto and enhance in the region of the bearing surface between the bracket 8 and the key 12.

The corners 20 between the central body 14 and arms 16 and 17 are formed relative to typically used plastic materials to prevent against breakage through normal use. Although not presently required for the intended tube sizes (i.e. less than 8.2 oz.), it is to be appreciated that structural stiffeners can be included where necessary at the corners or along the central body 14 and arms 16 and 17 to prevent against breakage. Similarly all edges and corners can be rounded or chamfered.

Figure 3:
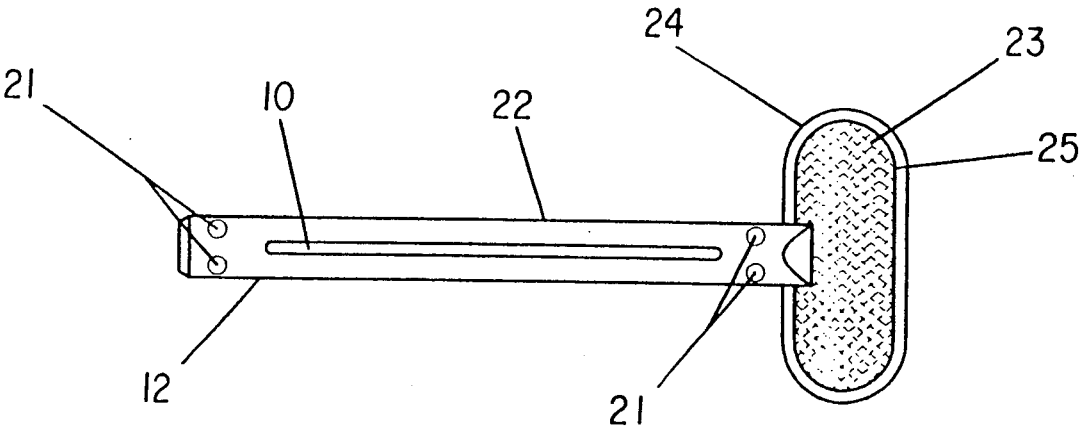
FIG. 3 shows an elevation view of the closed ended key of FIG. 2.
Figure 4:
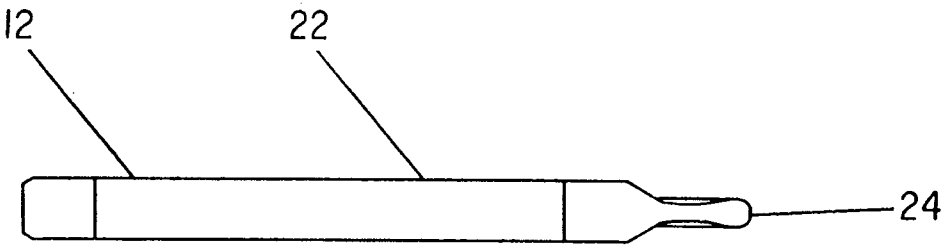
FIG. 4 shows a top plan view of the key of FIG. 3.
Figure 5:
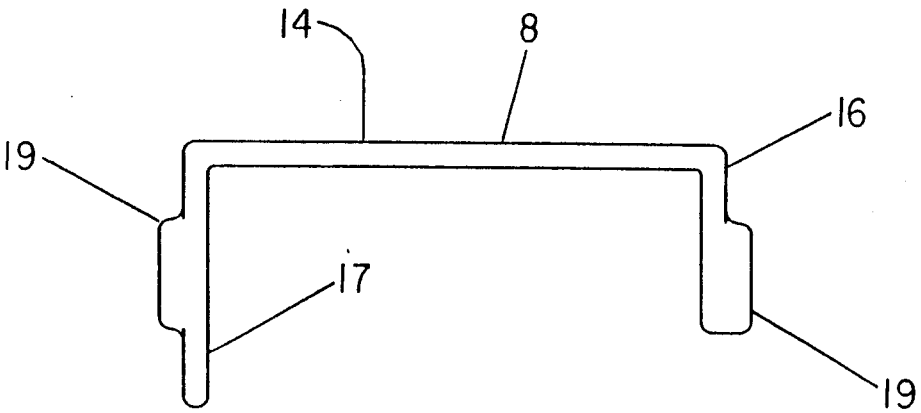
FIG. 5 shows an elevation view of the support bracket holder of FIG. 2.
Figure 6:
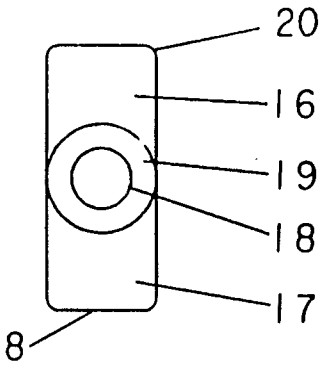
FIG. 6 shows a right end elevation view of the support bracket of FIG. 2.
Figure 7:
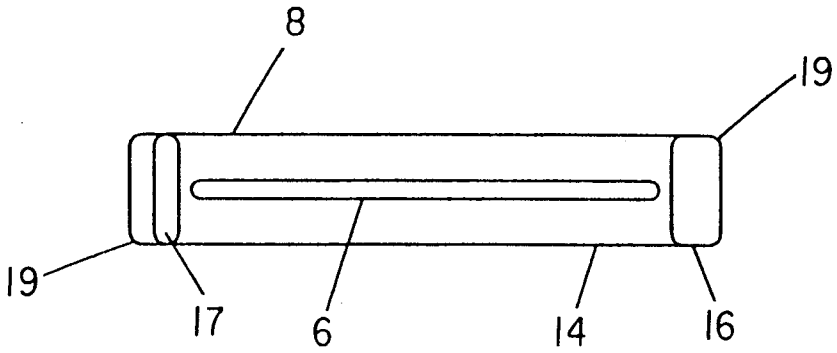
FIG. 7 shows a front elevation view of the support bracket of FIG. 2.

FIGS. 2, 3 and 4 otherwise disclose the details of the key 12 which is molded from a similar material to that of the support bracket 8. The key 12 provides a cylindrical body portion 22 and includes the substantially coextensive through slit or winder slot 10. At one end of the key, a hand wing 24 is provided. The wing 24 is sized and formed so that it can be grasped between the thumb and index finger during a winding operation. A knurled surface 23 is provided over the central depressed area 25 of the wing 24, on the upper and lower surfaces, to prevent slippage. Slight dimples or depressions 21 are provided in the regions where the key 12 is supported within the bores 18. The dimples 21 facilitate key rotation due to reduced frictional contact between the bracket and key 12.

Figure 8:
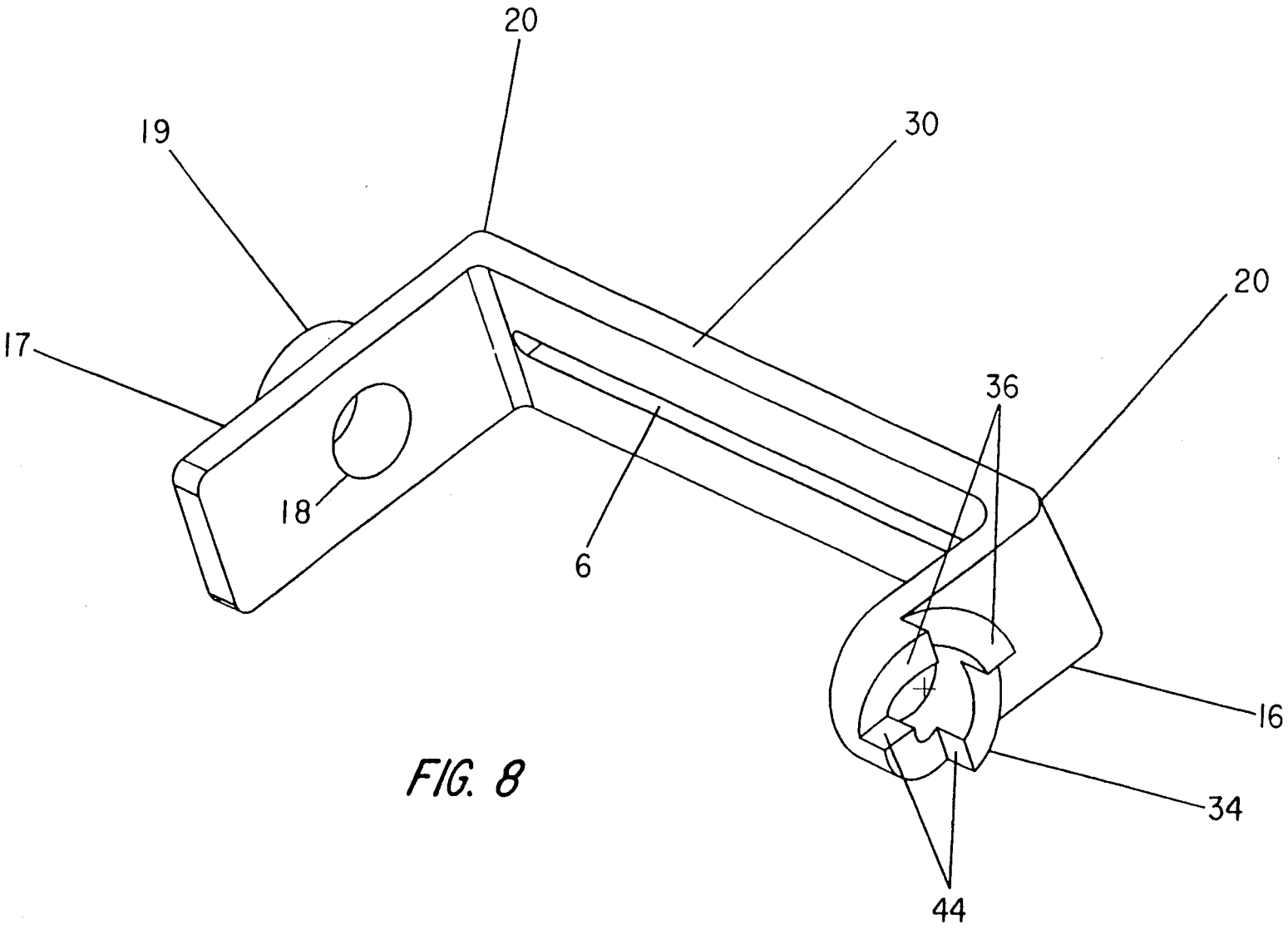
FIG. 8 shows an isometric view of an alternative, uni-directed support bracket.
Figure 9:
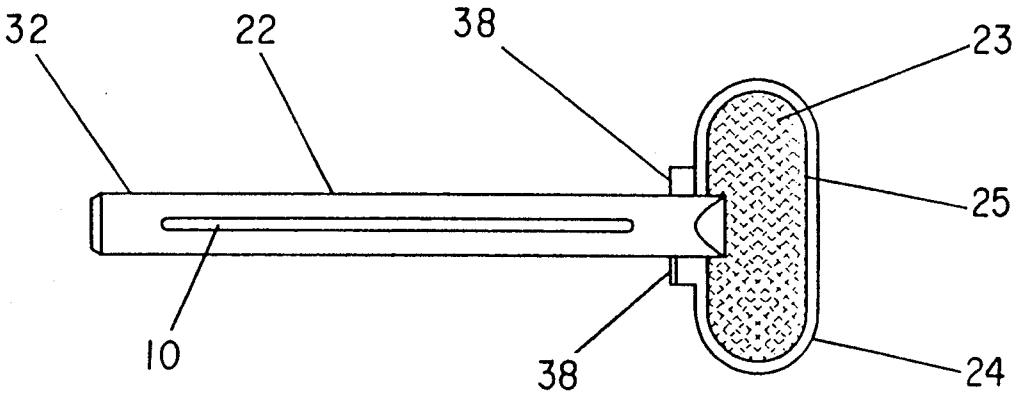
FIG. 9 shows an elevation view of a closed ended ratchet key used with the bracket of FIG. 8.
Figure 10:
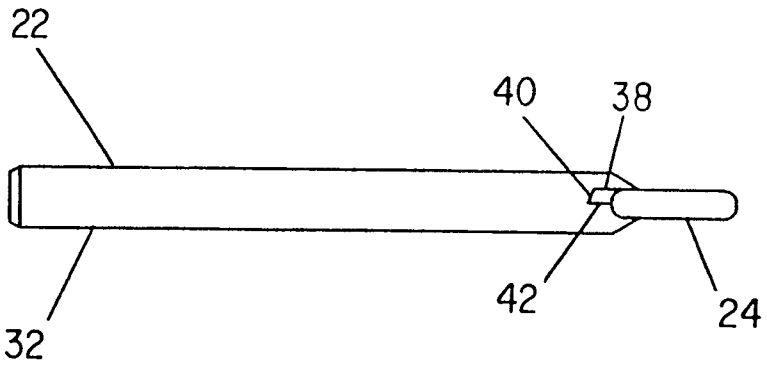
FIG. 10 shows a side elevation view of the key of FIG. 9.

While the key 12 permits either clockwise or counterclockwise relative to the bracket 8, attention is directed to FIGS. 8 through 10 where an alternative bracket 30 and key 32 are shown. The bracket 30 and key 32 are substantially the same as the bracket 8, however, the area 34 in the region of the bore 18 at arm 16 is configured differently. In particular a plurality of annularly arranged and outwardly ramped gear teeth 36 are formed to extend from the cylindrical body and mate with corresponding follower projections 38 which extend from the inner surface of the wing 24. The annular teeth 36 project from the arm 16 such that upon fully inserting the body of the key 32 within each bore 18, a ramped surface 40 of the follower projections 38 mate with the teeth 36 to provide for a unidirectional rotation of the key member 32, during tube takeup.

Reverse rotation is normally prevented via the flat vertical faces 42 and 44 of the followers 38 and teeth 36. The body length of the key 32, otherwise, is such that once fully spent or if it is desired to change tubes 4, the key 12 can be partially withdrawn such that the adjacent nongeared area of the body 22 rotates within the bores 18 to permit the opposite rotation and removal of the tube.

Figure 11:
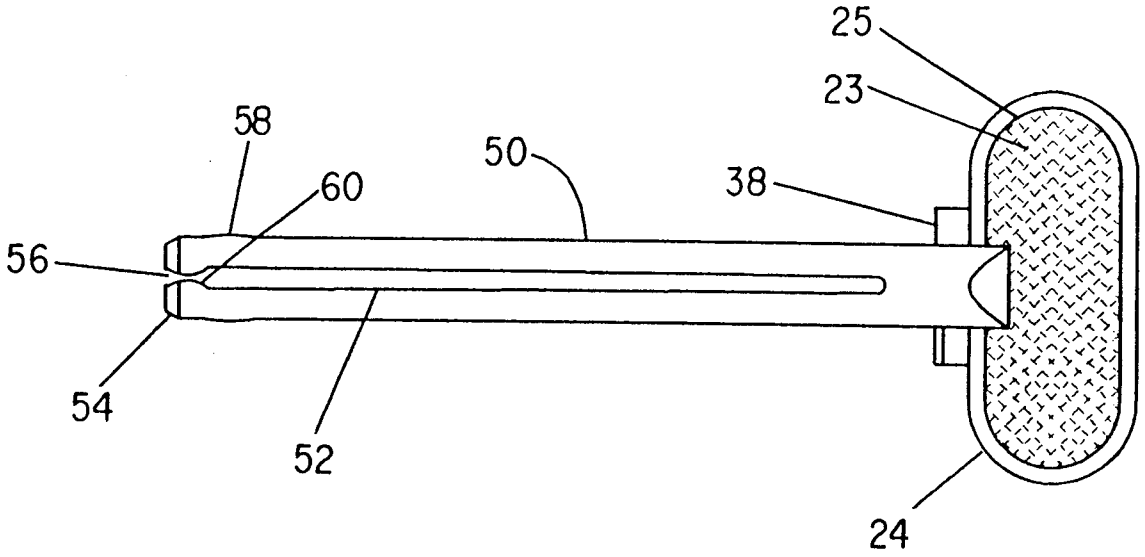
FIG. 11 shows an alternative open ended key.

Lastly, attention is directed to FIG. 11 which shows an alternative open ended key 50. Whereas each of the keys 12 and 32, required the unwinding of the key during tube removal, the key 50 can merely be withdrawn from the tube. That is, the winding slot 52 is open at its left end so that it can be separated from the tube and bracket upon merely withdrawing the key 50 from the bracket 8 or 30.

In the latter regard, the open end of the slot 52 is particularly shaped to provide a chamfered end 54 and centrally of which the slot 52 opens to a narrow slit 56. An annular bump or protrusion 58 is formed to the side of the slit 56 in the region where the key 50 mates with the bore 18. It is in the region 58 where the key 50 mounts within the bracket bore 18. Protrusions 60 formed centrally of the slit 56 project an equal distance to the projections 58. Once mounted, the protrusions 58 and 60 cause the slit 56 to be compressed fully closed and provide a comparable support surface to a closed-ended key 12 or 32.

It is to be appreciated one or more follower protrusions 38 can be provided at the wing 24 should the key 50 be used with a uni-directional bracket 30. A single protrusion is shown to exhibit this flexibility with either support bracket 12 or 30.

While the subject invention has been described as to its presently preferred embodiment and various considered modifications, it is to be appreciated that still other modifications and improvements might be considered by those of skill in the art. Accordingly, it is contemplated the following claims should be interpreted to include all those equivalent embodiments within the spirit and scope thereof.

What is claimed is:

1. Apparatus for evacuating a collapsible tube storage container comprising:

a) a bracket including a body portion having a through slot sized to receive a flattened end of said storage container and presenting a progressively inwardly tapering bore to the passage of the container and further including a par of integral arm portions orthogonally extending from opposite ends of said body portion in parallel relation to one another and wherein each arm portion includes a transverse cylindrical bore and one of said arm portions provides a hand hold extension;

b) a key including a cylindrical body portion mountable in coaxial rotative relation to the transverse bore of each of said arm portions and having a lengthwise slot extending from a distal end of the body portion and bisecting the body portion for receiving said flattened tube end one passed through the bracket slot and further including a hand graspable end portion containing projecting wing portions having finger depressions for rotating said body portion whereby the spent tube may be wound onto said key.

2. Apparatus as set forth in claim 1 wherein said bracket at one of the arm bores include a plurality of gear teeth concentrically projecting about said bore and said key includes at least one projection and wherein at a first key mounting position said gear teeth are formed and sized to mate with the key projection to permit a unidirectional rotation of said key relative said bracket and at a second mounting position the key may be partially withdrawn from the bracket to permit opposite rotation of the key upon disengaging the key projection from said gear teeth.

3. Apparatus for evacuating a collapsible tube storage container comprising:

a) a U-shaped bracket including a bridge portion having a through slot said slot sized to circumscribe a flattened end of said storage container and presenting a progressively inwardly tapering bore to progressively flatten said tube with passage through said bracket and further including a pair of integral arm portions projecting in parallel relation to one another from opposite ends of said bridge portion, wherein each arm portion includes a bore paralleling said bridge portion, wherein one of said arm portions provides a hand hold extension and wherein said bracket at one of the arm bores includes a plurality of gear teeth concentrically projecting about said bore;

b) a key having a body portion insertably mounting through the arm portion bores and having an open ended through slot sized to receive said flattened tube and once passed through the bridge slot and further including flattened, projecting wing portions containing finger depressions and at least one projection mating with said gear teeth for rotating said body portion, whereby the spent container may be unidirectionally wound about the key.

4. Apparatus as set forth in claim 3 wherein the key includes a plurality of recesses in the regions where the key is supported in said bracket and wherein the key includes means for closing the open end of the through slot upon mounting the key within the bracket.

5. Apparatus for evacuating a collapsible tubular storage container comprising:

a) a U-shaped bracket having:

(1) a bridge portion having a through slot, said slot sized to circumscribe a flattened end of said storage container and presenting a progressively inwardly tapering bore to the passage of the container; and (2) a pair of integral arm portions orthogonally projecting in parallel relation to one another from opposite ends of said bridge portion, wherein each arm portion includes a bore paralleling said bridge portion and wherein one of said arm portions provides a hand hold extension portion;

b) a key having a body portion insertably mounting through the arm portion bores and including a through slot sized to receive said flattened tube end once passed through the bridge slot and further including flattened, projecting wing portions containing finger depressions and whereby the key is rotated within said bracket and the spent container is wound about the key as the tube contents are squeezed from said tube at the bridge portion.

6. Apparatus as set forth in claim 5 wherein the finger depressions are knurled.

7. Apparatus as set forth in claim 5 wherein the body portion of said key includes a plurality of recesses in the regions where said key is supported in said bracket.

8. Apparatus as set forth in claim 5 wherein the through slot extends from a distal end of the body portion and lengthwise bisects the body portion and wherein a protrusion extends from the distal end, such that upon mounting the key to the bracket the distal end is compressed to secure the key to the bracket, whereby said key may be extracted from a wound tube without unwinding the tube.

9. Apparatus as set forth in claim 5 wherein said bracket at one of the arm bores includes a plurality of gear teeth concentrically projecting about said bore, wherein said key includes at least one projection, wherein at a first mounting position said gear teeth are formed and sized to mate with the key projection to permit a unidirectional rotation of said key relative said bracket and at a second mounting position the key may be partially withdrawn from the bracket to permit opposite rotation.

* * * * *